United States Patent [19]

Barnett

[11] 4,145,960

[45] Mar. 27, 1979

[54] BOX CLOSING MACHINE

[76] Inventor: Harry Barnett, 2990 SW. 22nd St., Fort Lauderdale, Fla. 33312

[21] Appl. No.: 786,256

[22] Filed: Apr. 11, 1977

[51] Int. Cl.[2] ..... B65B 7/20

[52] U.S. Cl. ..... 93/41.1; 93/36.3; 53/374

[58] Field of Search ..... 53/138 R, 374, 124 A, 53/124 CC; 93/36.3, 36.9, 49 R, 41, 41.1

[56] References Cited

U.S. PATENT DOCUMENTS

| | | | |
|---|---|---|---|
| 2,132,516 | 10/1938 | Paxton et al. | 53/138 R X |
| 2,276,541 | 3/1942 | Howard | 53/124 A |
| 2,714,792 | 8/1955 | Wright et al. | 53/124 A |
| 2,891,367 | 6/1959 | Shenigo | 53/374 |
| 3,126,685 | 3/1964 | Paxton et al. | 53/374 X |

*Primary Examiner*—James F. Coan

*Attorney, Agent, or Firm*—Malin & Haley

[57] ABSTRACT

A machine for closing the lids of a box, especially over filled agricultural produce boxes. The flaps of a paper box are individually closed and pressed shut to compact the contents within the box, and make ready for fastening the lid closed. The machine includes a motor driven conveyor means on which the boxes are placed for movement through the closing and compacting portions of the machine and into and out of the fastening portion of the machine. Belt means and movable and stationary finger means are used in combination with a compacting mechanism to close the flaps and compact the box. A lifting device between and below the conveyor means lifts the boxes off of the moving conveyor into engagement with a fastening device that fastens the flaps of each box shut before it is lowered back onto the conveyor belt for movement out of the machine.

3 Claims, 6 Drawing Figures

BOX CLOSING MACHINE

BACKGROUND OF THE INVENTION

This invention is for a lid closing, compacting and fastening machine. In the past many types of closing devices have been designed. Such devices have been complex and expensive. Such devices usually require the box to be underfilled for proper closing and fastening.

BRIEF SUMMARY OF THE INVENTION

This invention relates generally to a machine for folding the flaps of a paper box closed, compacting the contents within the box, and fastening the lid shut. More specifically this invention operates to perform the above functions on slightly overfilled boxes placed on the entrance of a motor driven conveyor means. The conveyor includes two spaced apart belts or chains which move along a plane through the machine. The conveyor moves each box under at least one closing belt. The closing belts are on belt wheels or sprocket wheels which are positioned in relation with and move in the same direction as the conveyor means. The closing belt or belts are positioned over the conveyor so that the belt decreases in height above the conveyor between the entrance to the conveyor and a down stream position. When the front leading flap of the box reaches the point where the distance between the conveyor means and the closing belt above the conveyor is equal to the height of the sides of the box plus the height of the front vertically oriented leading flap, the closing belt will begin to close the leading flap. As the second flap, the trailing rear flap, moves under movable finger means, the finger means are automatically activated to tip the trailing rear flap of the box into a forward position, partially closing the trailing rear flap. Thereafter, when the trailing rear flap of the box moves into contact with the closing belt it will be forced into a closed position. The closing belt will close both the leading and trailing flaps and compact the material in the box.

As the box moves further down stream into the middle of the machine, both of the side flaps of the box come into contact with fixed closing means or cam rails as shown. Moving belt means may be used in place of the cam rails. The fixed closing means include two cam rails, one on each side of the conveyor. The forward end of the cam rails are placed at a height to make contact with the leading side edge of the side flaps of the box. The trailing edge of the cam rails, positioned further down stream, are placed at a height approximately equal to the height of the sides of the box. The side flaps are closed as the boxes pass under the side cam rails. The distance between the two cam rails narrows from the leading edge to the trailing edge where the rails or bars reach the approximate height of the sides of the box. The box is passed under the cam rails to push the side flaps down into a closed position. Thereafter, the box is moved into the upper drive means that also compacts the material in the box. The conveyor moves the box under a wide compacting wheel to flatten the closed flaps and compacts the goods within the box.

Then the box is moved into the fastening portion of the machine. Each box is then moved over a lifting device which lifts the box from the conveyor, thus stopping the forward motion of the box. The box is then moved upward placing the closed and compacted top of the box into engagement with a fastening device. The fastening device is automatically operated by a tripping means. The fastening device may be a stapling gun which permanently seals the flaps shut. The lifting device then lowers each box back onto the conveyor means for movement out of the machine.

The machine consists of a motor and gear speed reducing means mounted on a base. The motor drives the gear speed reducing means. The shaft of the gear reducing means may drive the lifting device. The lifting device may also be driven by a solenoid or air cylinder scissor mechanism. The other drive wheel on the shaft of the gear reducing means is connected directly to the conveyor sprockets to drive the two parallel conveyor chains, the closing belt means, the finger means and the compacting means.

It is an object of this invention to provide a machine which is able to quickly fold the flaps of a paper box closed, compacting the contents within the box, and fastening the lid closed in a single operation.

It is another object of this invention to provide an economical box closing and compacting machine that will reduce labor costs for closing and sealing boxes.

It is another object of this invention to provide a box closing and compacting machine small enough to be easily transportable to other locations.

These together with other objects and advantages will become apparent to those skilled in the art upon reading the details of construction and operation as more fully set forth hereinafter, reference being made to the accompanying drawings forming a part hereof, wherein like numerals refer to like parts throughout.

DESCRIPTION OF THE PREFERRED EMBODIMENT

Figure 2:
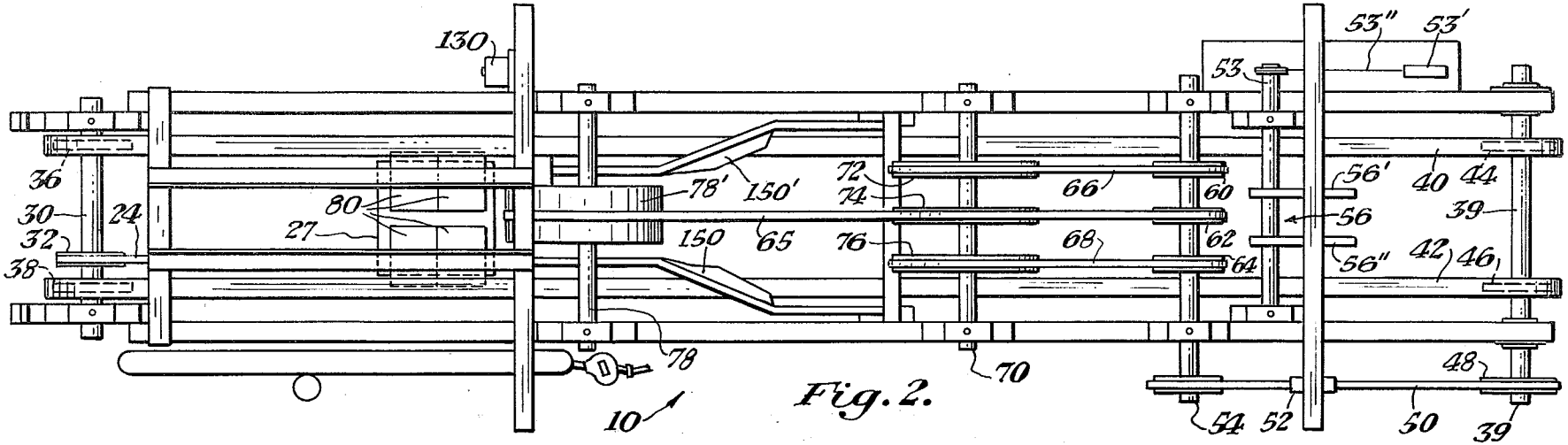
FIG. 2 is a top view of the machine.
Figure 1:
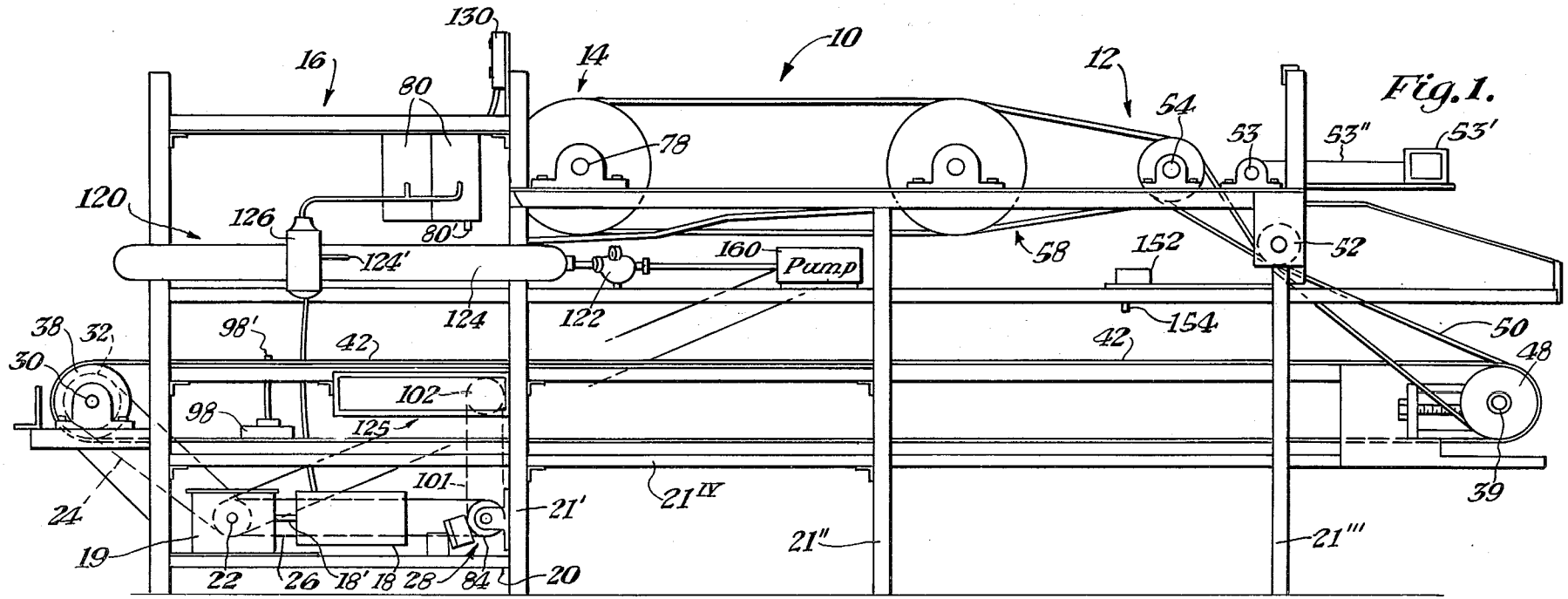
FIG. 1 is a side view of the machine.

Referring now to the machine 10 in FIGS. 1 and 2, the machine consists of three portions, a leading and trailing flap closing and compacting portion 12, a side flap closing, upper drive and compacting portion 14 and a sealing portion 16. A motor 18 with drive shaft 18' driving gear reducing means 19, all of which is mounted on a base 20. The shaft 22 of the gear reducing means 19 has two drive wheels or sprocket wheels thereon. One drive wheel has a chain 26 around it, said chain 26 connecting directly or indirectly to a drive wheel on a clutch device 28. The other drive wheel on the gear reducing means has a chain 24 around it which connects directly to another sprocket 32 on a shaft 30. Shaft 30 has two additional sprockets 36-38 connected to it. These two sprockets 36-38 are connected to two other sprockets 44 and 46 on a second shaft 39. Shaft 39 has three wheels or sprockets 44-46-48 on it. Two loops of chain 40-42 pass over wheels 36-38-44-46 to form a conveyor belt.

The third wheel 48 is connected via a belt 50 to drive 54. The support frame includes vertical members 21, 21, 21'' and 21''' and member 21$^{iv}$.

Idler wheel 52 is positioned to engage belt 50 to provide tension. Shaft 54 rotates the closing belt means 58.

Shaft 53 is driven by solenoid 53' or an air cylinder that actuates wire 53" wrapped around shaft 53 to rotate shaft 53 approximately 135 degrees. Shaft 53 drives finger device 56 including fingers 56'-56".

The three wheels 60-62-64 on shaft 54 are connected via two belts 66-68 to shaft 70 with three wheels 72-74-76 on it. Belts 66-68 close the leading and trailing flaps and compact the material in the box. The wheels 62 and 74 are connected by belt 65 to yet another shaft 78 with an upper drive and compacting wheel 78' on it. Belt 65 holds the leading and trailing lids down. The width of belt 65 fit between the closed edges of the side flaps. The adjacent edges of the side lids of the box do not touch each other in a closed position in the preferred box configuration. The edges of the leading and trailing flaps do not touch each other in the preferred box configuration. An additional wheel may be positioned between wheels 74 and 78'.

The sealing portion 16 includes fastening devices 80 (such as staple guns) above the conveyor means 40-42. The fastening devices 80 may be four stapling guns connected to air power source 120. The regulator and gauge is shown at 122. Surge tank is shown as 124. Lubricator is shown as 126 connected to the stapler devices. Air enters a surge tank through regulator 122. Conduit 124' connects the surge tank 124 to lubricator 126 that drives the fastening devices 80. The box when lifted by lift means 125 engages trigger means 80' to activate the fastening devices 80.

Figure 5:
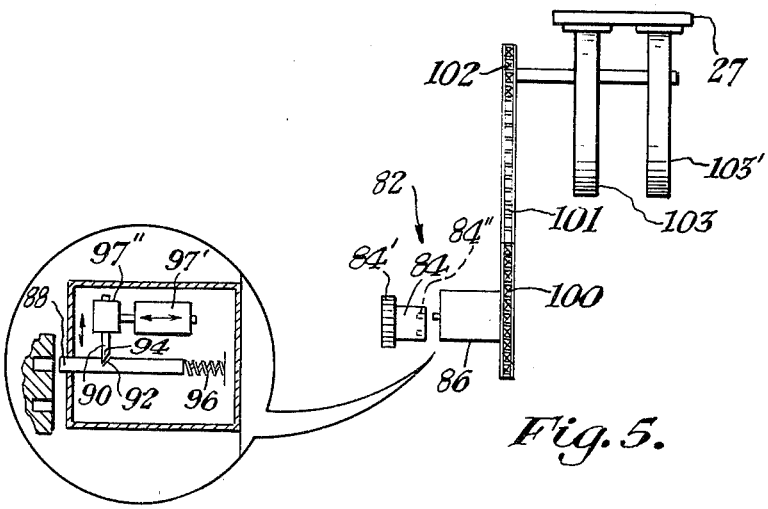
FIG. 5 is an isometric view of the lift mechanism.

The clutch device 28 previously mentioned is located below the conveyor chains 40 and 42 below the fastening device. The clutch device 28 includes clutch 82 shown in FIG. 5. The clutch 82 includes a free running drive wheel or sprocket wheel 100 driven by chain 26 shown in FIG. 1. The clutch connecting means 86 includes a spring biased pin connector 88 and actuating lever 90. The pin 88 has an upper cam 92 that mates with actuating lever 90 having a cam face 94. Lever 90 moves the pin 88 away from sprocket wheel 84' against a biasing means 96 to disengage the clutch. Solenoid 97' moves lever 90 to the right. Solenoid 97" raises lever 90 to allow pin 88 to engage member 84. A switch 98 having arm 98' is positioned in the conveyor system for actuation by a box on the conveyor. Switch 98 actuates the solenoid 97" to disengage the lever 90 and the cam 92 to engage the clutch and move a box into engagement with the stapler devices. The return of the lift mechanism triggers solenoid 97' to disengage the clutch pin 88.

When clutch 28 is engaged it rotates a lifting cam that quickly moves a platform 27 upward with a box to place the box into engagement with the stapler devices. Clutch 28 through wheel 84' rotates chain 101 that drives shaft 102. Shaft 102 drives cams 103 and 103'. The cams 103 and 103' work together to lift table 27. The cams 103 and 103' are rotated about a center point near its circumference to hold the table 27 fairly steady at the upper position for movement through an angle of approximately 80° to 90° of the rotation of cams 103 and 103'.

Figure 6:
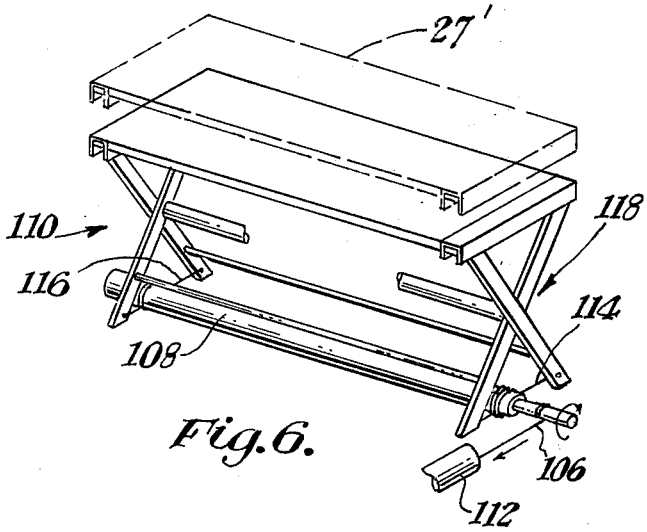
FIG. 6 is an isometric view of another lifting mechanism.

Now referring to FIG. 6, a scissor device 110 may be used to raise the table 27' and a box. The weight of the table 27' and the box returns the box to its lower position. Thereafter the conveyor chains 40-42 move the box off the table.

A solenoid 112 or air cylinder actuates a cable 106 that is wrapped around a shaft 108. The cable 106 rotates shaft 108. The rotating shaft 108 pulls on cables 114 and 116 and wraps them further around the shaft 108. The other ends of cables 114 and 116 are connected to the end of the scissor lift 118. The scissor lift is moved by cables 114 and 116. Platform 27' moves up to place the box in engagement with the stapler means 80. A phantom upper position of table 27' is shown in FIG. 6 to illustrate movement upward.

Main power control box, illustrated as 130, is connected to motor 18 and also connected to the solenoids and switches. The main power may also be connected to a pump means not shown in order to provide air into regulator 122.

The machine closes the lids of over-filled agricultural produce boxes. The flaps of a paper box are individually closed and pressed shut in order to compact the contents within the box, and make ready for fastening the lid closed. A motor driven conveyor means moves the boxes through a closing portion 12 and compacting portion 14 of the machine and through a fastening portion 16 of the machine. Belt means 66 and 68 and movable fingers 56 and stationary finger means 150 and 150' are used in combination with the upper drive and compacting wheel 78' to close the flaps and compact each box. A lifting platform 27 between and below the conveyor means is used to lift the boxes off of the conveyor 40-42 into engagement with a fastening device 80 that fastens the flaps of each box shut before it is lowered back onto the conveyor belt for movement out of the machine.

This invention operates to perform the closing, compacting and fastening functions on filled boxes as well as on slightly overfilled boxes that are placed on the motor driven conveyor means. The conveyor includes two spaced apart belts or chains 40-42 which move along a horizontal plane path through the machine. The conveyor moves each box under at least one closing belt. The closing and compacting belts are on belt wheels or sprocket wheels which are positioned in relation with and move in the same direction as the conveyor means. The closing and compacting belt or belts are positioned over the conveyor so that the belt decreases in height above the conveyor between the entrance to the conveyor and a down stream position. The box moves into the machine as shown at A in illustration FIG. 4. When the front leading flap of the box reaches the point where the distance between the conveyor means and the closing belts 66-68 above the conveyor is equal to the height of the sides of box plus the height of the vertically positioned front leading flap of the box, the closing belt will contact the front leading flap to close it, as shown at B. As the second flap, the trailing rear flap, moves under movable finger means 56, the finger means 56 are automatically activated by the box engaging switch 152 and toggle 154. The switch is connected to solenoid 53' to activate solenoid 53'. Solenoid 53' pulls cable 53'" to rotate shaft 53 as the cable unwinds. The trailing rear flap is pushed into a forward position as shown at C to partially close the trailing rear flap. Thereafter, the trailing rear flap of the box moves into contact with the closing belts 66-68 to force the flaps into a closed and compacted position as shown at D.

Figure 4:
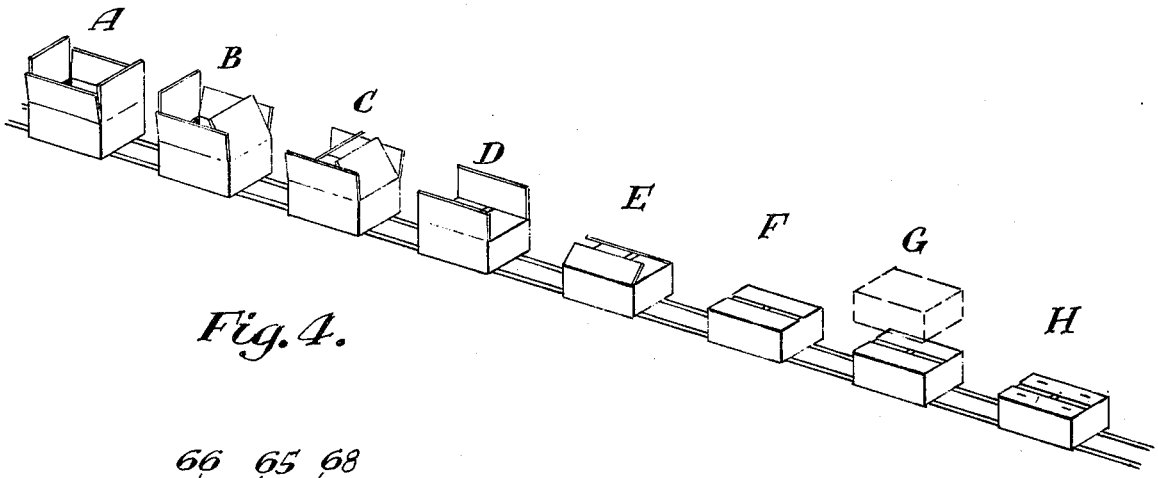
FIG. 4 is an illustration of the closing sequence of the machine.
Figure 3:
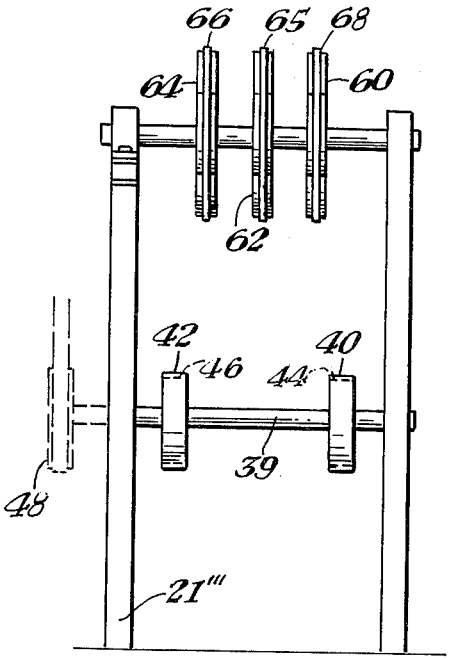
FIG. 3 is a front end view of the machine with the belts and chains in cross section and with the fingers removed.

As the box moves further down stream into the middle of the machine, both of the side flaps of the box come into contact with fixed closing means or cam rails 150-150' as shown in FIG. 4 at E. Moving belt means may be used in place of the cam rails. The fixed closing means 150-150' include two cam rails, one on each side of the conveyor. The forward end of the cam rails are placed at a height to make contact with the leading side edge of the side flaps of the box. The trailing edge of the cam rails, positioned further down stream are placed at a height approximately equal to the height of the sides of the box. The side flaps are partially closed as shown at E and fully closed as shown at F as the boxes pass under and completely past the side cam rails. The distance between the two cam rails narrows from the leading edge to the trailing edge where the rails or bars reach the approximate height of the sides of the box. The box is passed under the cam rails to push the side flaps down into a closed position. Thereafter, the box is moved into the upper drive and compacting area 14. The conveyor moves the box under a wide upper drive and compacting wheel 78' to drive and flatten the closed flaps and further compacts the goods within the box as shown in FIG. F.

Then the box is moved into the fastening portion 16 of the machine. Each box is then moved over a lifting device which after contacting switch 98' lifts the box from the conveyor as shown in G in phantom, thus stopping the forward motion of the box. The box is then moved upward placing the closed and compacted top of the box into engagement with fastening devices 80. The fastening devices 80 are automatically operated by a tripping means 80'. The fastening devices 80 may be stapling guns which permanently seal the flaps shut. The lifting device then lowers each box back onto the conveyor means for movement out of the machine, as shown at H.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A box closing apparatus for closing and sealing boxes with a forward lid, rear lid, and two side lids placed in said apparatus with the lids in a generally vertical position comprising:

a frame, drive means connected to said frame, said drive means including a drive train and a prime mover, said drive train connected to said prime mover, a continuously moving conveyor means for moving boxes through said apparatus, said conveyor means connected to said drive train of said drive means for continuous movement and connected to said frame, said conveyor means having an entrance, a lid closing area, a sealing area, and an exit, said conveyor means moving boxes through said areas at a continuous and constant speed, a closing means connected to said drive means and said frame, said closing means positioned above the lid closing area of said conveyor for moving the box lids from a generally vertical position to a generally horizontal closed position, a sealing means connected to said drive means and positioned adjacent said sealing area, said sealing means including sealing means for sealing the lids into a closed position when the boxes positioned adjacent said sealing means, and movable means connected to said drive means for independent operation and connected adjacent said sealing area, said movable means positioned for lifting each box off said conveyor to position the box adjacent said sealing means and for returning the box to said conveyor after sealing, whereby the conveyor continuously moves when a box is lifted off the conveyor in the sealing area.

2. A box closing apparatus as set forth in claim 1 wherein:

said conveyor means includes a compacting area, a compacting means for flattening the closed lids of each box into a generally horizontal position as each box moves through said apparatus on said conveyor, said compacting means and said compacting area connected between said closing area and said sealing area.

3. A box closing apparatus as set forth in claim 1 wherein:

said entrance area sized to allow each box to be placed on a conveyor for transmission through the apparatus with the lids in a generally vertical position, said closing means including a forward and rear lid closing means, a rear lid tilting means, and side lid closing means, said forward and rear lid closing means connected to said drive means and said frame, said forward and rear lid closing means positioned above said conveyor to close the forward and rear lids as each box passes the lid closing area, said rear lid tilting means connected to said drive means and positioned above said conveyor to tilt each rear lid prior to the rear lid reaching said forward and rear lid closing means, said side lid closing means positioned above said conveyor for closing the sides of the box on top of the previously closed forward and rear lids, said sealing means is a stapling means positioned above said conveyor, said moveable means including a moveable platform means connected to said drive means for removing each box from the moving conveyor and placing it in contact with said stapling means and actuating said stapling means for stapling the lids of each box into a sealed position and thereafter returning each box to the conveyor for exit out of said apparatus.

* * * * *